US006131752A

United States Patent [19]

Wurzer et al.

[11] Patent Number: 6,131,752

[45] Date of Patent: Oct. 17, 2000

[54] BEARING BLOCK FOR LIGHTWEIGHT DRAWBAR ASSEMBLY

[75] Inventors: Jeffrey D. Wurzer, Turtle Creek; Shawn A. Opfer, Pittsburgh, both of Pa.

[73] Assignee: McConway & Torley Corporation, Pittsburgh, Pa.

[21] Appl. No.: 09/154,852

[22] Filed: Sep. 17, 1998

[51] Int. Cl.[7] ..... B61G 9/00

[52] U.S. Cl. ..... 213/71; 213/69; 213/72

[58] Field of Search ..... 213/71, 61, 62 R, 213/75 R, 62 A, 67 A, 67 R, 72, 69

[56] References Cited

U.S. PATENT DOCUMENTS 5,080,242 1/1992 Steffen et al. ..... 213/75 R
5,096,075 3/1992 Glover ..... 213/61
5,207,718 5/1993 Glover et al. ..... 213/62 R
5,361,917 11/1994 Mautino et al. ..... 213/50

*Primary Examiner*—S. Joseph Morano
*Assistant Examiner*—Lars A. Olson
*Attorney, Agent, or Firm*—James Ray & Associates

[57] ABSTRACT

A bearing block for use in combination with a slackless drawbar coupler assembly for joining railway cars, wherein the bearing block is adapted for use in pivotally attaching a drawbar to a drawbar pivot pin and the drawbar is provided with a generally rectangular aperture through which such drawbar pivot pin is inserted, the bearing block comprising, a generally three-sided body having three generally rectangular side surfaces adapted to engage against the side surfaces of the generally rectangular aperture, and includes a fourth surface defining a concave cylindrical surface adapted to engage against a cylindrical side surface of the drawbar pivot pin, such that when properly inserted into the drawbar assembly, the drawbar will bias the cylindrical surface against the pivot pin.

3 Claims, 2 Drawing Sheets

BEARING BLOCK FOR LIGHTWEIGHT DRAWBAR ASSEMBLY

CROSS REFERENCE TO RELATED APPLICATIONS

The invention taught in this patent application is closely related to the inventions taught in four co-pending patent applications, namely: LIGHTWEIGHT DRAWBAR ASSEMBLY, Ser. No. 09/154,792, SPOOL FOR LIGHTWEIGHT DRAWBAR ASSEMBLY, Ser. No. 09/156,304, DRAWBAR FOR LIGHTWEIGHT DRAWBAR ASSEMBLY, Ser. No. 09/156,542, SUPPORT HOUSING FOR LIGHTWEIGHT DRAWBAR ASSEMBLY, Ser. No. 09/154,610, all of which are being filed concurrently herewith. These patent applications are assigned to the assignee of this invention, and the teachings therein are incorporated into this application by reference thereto.

FIELD OF THE INVENTION

The present invention relates, in general, to drawbar assemblies for interconnecting railway cars. More particularly, this invention relates to a unique bearing block useful for pivotally connecting a drawbar to a drawbar pivot pin within such a drawbar assembly, and specifically, a bearing block which is disposed between a surface of the drawbar and an edge surface of the pivot pin so that the drawbar is continually maintained in biased condition against the pivot pin regardless of any wear.

BACKGROUND OF THE INVENTION

In 1932, the Type E coupler was adopted as the ARA, American Railway Association (predecessor to the AAR, Association of American Railroads) standard coupler for railway freight cars. Although modified periodically since then to meet changing requirements imposed by changing demands, and other coupler designs have been developed for special applications, the Type E coupler is today still the standard coupler for freight service. As is well known, the Type E coupler as well as other standard use couplers, have a degree of free and cushioned slack. That is, a certain amount of free "play" exists between the coupler components when the load is changed from draft to buff loading, and visa versa. At the same time, the draft gear acts as a spring mechanism to cushion impact between adjacent cars. It has been found that eliminating the free and cushioned slack within a train can eliminate over the road train action forces due to "run-ins" and "run-outs". The magnitude of these forces are large and cause significant wear and tear of the rolling stock, and in some cases can be significant enough to cause derailments.

More recently, slackless drawbar couplers have come into use which were developed for use in unit train applications where interconnected cars are uncoupled only rarely for periodic inspection and repair, with the coupling essentially comprising a rigid drawbar with one end pivotally connected to one car and the other end pivotally connected to the adjacent car. Such jointed cars are not subjected daily to impact forces associated with bumping encountered in classification yards, and, therefore, do not require cushioning devices such as draft gears. Accordingly, because of their significant lighter weight, such slackless drawbar couplers are in widespread use in unit trains, such as coal trains, and other captive use applications.

An example of such a slackless drawbar coupling is disclosed in U.S. Pat. No. 4,580,686, the disclosure of which is incorporated herein by reference. This patented coupling system provides a drawbar arrangement for coupling railway cars each having a center sill and trucks at its opposite ends, the trucks being pivotal about vertical king pins. The drawbar has an enlarged spherical butt end portion defining essentially convex spherical buff and draft load surfaces, a rear support block having a tapered rear surface and a concave substantially hemispherical buff load bearing surface adapted to engage with the convex buff load bearing surface of the butt end portion of the drawbar, a slack adjusting wedge for engaging the tapered surface of the rear support block, means for transferring buff loads from the slack adjusting wedge to the center sill, a front draft block having a concave and substantially hemispherical draft load bearing surface adapted to engage with the convex draft load surface of the enlarged spherical butt end portion, the front draft block including an annular draft load surface opposite the hemispherical draft load surface thereof, a wear block having an annular draft load surface adapted to engage the annular draft load surface of the front draft block, and means supported by the center sill for transferring a draft load from the wear block to the center sill. Although there are other slackless drawbar designs, most can be divided into two basic types, those in which the drawbar is rotary, as described above where the drawbar has a spherical head portion, and those where the drawbar is not rotary, as for example, where the end of the drawbar is secured with a single pivot pin securing it to a base structure.

The above cited co-pending application titled "LIGHTWEIGHT DRAWBAR ASSEMBLY", Ser. No. 09/154,792, teaches a unique new and improved slackless drawbar assembly of the non-rotary type, which meets all AAR specifications, is significantly lighter in weight and yet stronger than prior art drawbar systems, and is virtually slack free.

SUMMARY OF THE INVENTION

This invention is predicated on a unique bearing block as is utilized in a preferred embodiment of that new and improved drawbar assembly, and generally, as may be utilized in any drawbar assembly for maintaining a slackless interface between the drawbar and drawbar pivot pin regardless of any degree of wear at such interface. The unique new bearing block of this invention provides a new and improved design and form for attaching the drawbar to the drawbar pivot pin, which design serves to maintain a slackless interface between the drawbar and the pivot pin connected thereto even when the bearing block becomes worn.

In essence, the unique and improved slackless drawbar assembly itself, like other slackless drawbar systems, is adapted for use in combination with railway cars having a center sill, and is incorporated into the center sill. The assembly includes a drawbar having a shank portion extending to an enlarged truncated butt end portion defining essentially a convex, hemispherical buff load bearing surface, with an aperture at the axis of the hemispherical buff load bearing surface, with the shank portion projecting from the convex, hemispherical buff load bearing surface. A rear support block or follower, having a concave, hemispherical buff load bearing surface is disposed adjacent to the convex, hemispherical buff load bearing surface on the drawbar, and a gravity activated, slack adjusting wedge is utilized to maintain the intersecting hemispherical surfaces in biased contact.

The bearing block of this invention can be utilized for pivotally securing the drawbar to a drawbar pivot pin, and comprises a generally rectangular three-dimensional body having a concave, cylindrical surface on one side adapted to engage the cylindrical side surface of the pivot pin, and having a flat surface opposite the concave, cylindrical surface, which is adapted to abut against a flat side wall surface of a generally rectangular aperture through the drawbar, such that the flat wall will function to maintain the bearing block biased against the pivot pin.

As in other slackless drawbar designs, a gravity activated, slack adjusting wedge is disposed between a rear support block and a side surface of the cavity in the support housing which is adapted to bias the rear support block against the convex partial hemispherical buff load bearing surface of the drawbar. In this function, the slack adjusting wedge also biases the drawbar against the drawbar pivot pin to take up any slack as may develop at the interface between the drawbar and its pivot pin.

OBJECTS OF THE INVENTION

It is, therefore, one of the primary objects of the present invention to provide a new and improved bearing block for pivotally joining a railway drawbar to the drawbar pivot pin.

Another object of the present invention is to provide a new and improved bearing block of simple design which even when worn, will maintain a slackless interface between the drawbar and the drawbar pivot pin.

Still another object of the present invention is to provide a new and improved bearing block for use in pivotally connecting a drawbar to a drawbar pivot pin, which bearing block maintains a slackless interface between the drawbar and the pivot pin regardless of bearing block wear.

In addition to the above-identified objects and advantages of the present invention, various other objects and advantages of such invention will become more readily apparent to those persons who are skilled in the railway coupling art from the following more detailed description of the invention, particularly, when such description is taken in conjunction with the attached drawing figures and with the appended claims.

DESCRIPTION OF A PREFERRED EMBODIMENT OF THE INVENTION

Figure 1:
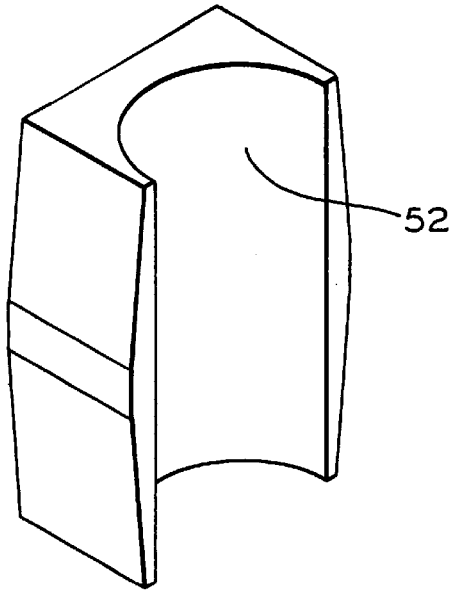
FIG. 1 is a an isometric view of the bearing block in accordance with a preferred embodiment of this invention.

Prior to proceeding with a more detailed description of the invention it should be noted that, for the sake of clarity, identical components having identical functions have been identified with identical reference numerals throughout the several views of the drawings.

Figure 3:
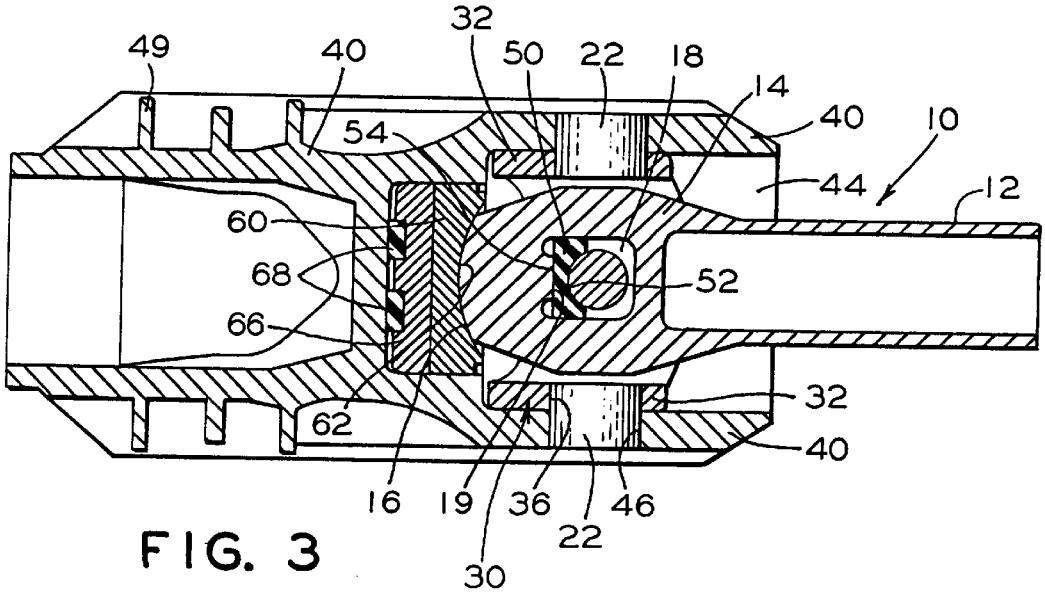
FIG. 3 is a cross-sectional plan view of the entire above-noted drawbar coupler assembly incorporating a bearing block in accordance with a preferred embodiment of this invention as shown in FIG. 1.
Figure 4:
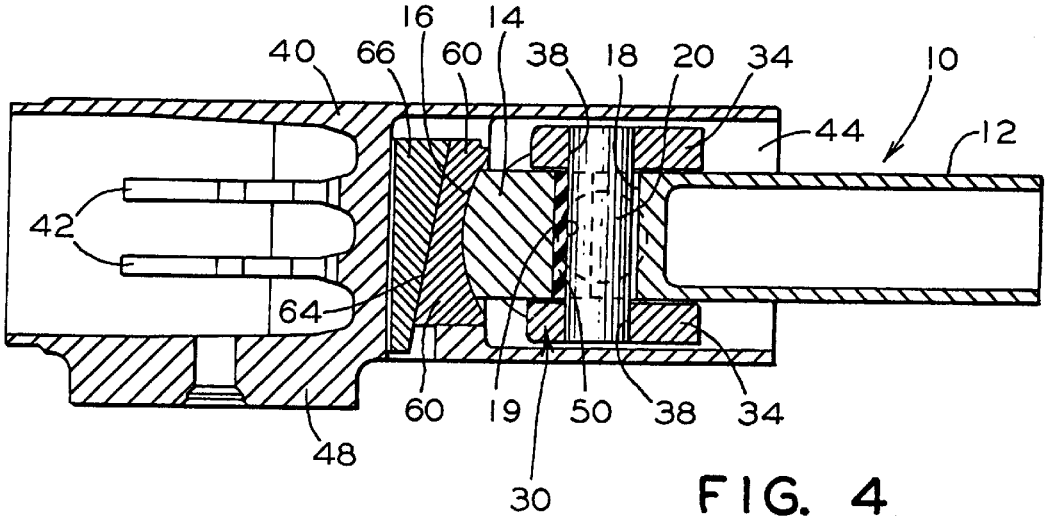
FIG. 4 is a cross-sectional side view of the entire drawbar coupler assembly shown in FIG. 2.

Before considering the unique and inventive bearing block of this invention, a complete understanding of the unique drawbar assembly would be helpful. Accordingly, reference to FIGS. 3 and 4 will illustrate the unique slackless drawbar assembly in which the bearing block of this invention is utilized, wherein a presently preferred embodiment comprises an elongated drawbar 10 having a shank portion 12 extending to an enlarged truncated butt end portion 14, defining essentially a convex, partial hemispherical buff load bearing surface 16, and having a generally rectangular aperture 18 at the axis of said hemispherical buff load bearing surface 16. As can be seen, the shank portion 12 projects forwardly from the convex, partial hemispherical buff load bearing surface 16. While the drawbar 10 is shown to be rectangular in cross-section, other cross-sectional forms would work as well. Although the buff load bearing surface 16 is hemispherical, it is clear that it is not a full hemisphere, in that it is limited by the rectangular side edges of the drawbar 10. Accordingly, while a fuller hemispherical form could be utilized if desired, such would merely add unnecessary weight and mass to the drawbar 10.

A unique spool generally 30, is provided for supporting an end of drawbar 10, which spool 30, comprises a generally rectangular sleeve-like body having a first pair of parallel side wall members 32 vertically extending from a second pair of parallel, horizontally disposed top and bottom wall members 34. Hence, wall members 32 and 34 essentially define a box-like sleeve body with both horizontal ends open, into which an end of drawbar 10 is inserted. A first pair of axially aligned apertures 36 are disposed through the first pair of parallel, vertically disposed, side wall members 32 each of which is adapted to receive an interlocking disk member 22 for pivotally connecting spool 30 to a support housing 40 described below. A second pair of axially aligned apertures 38 are disposed in the second pair of parallel, horizontally disposed, top and bottom wall members 34, which are adapted to receive a drawbar pivot pin 20.

A support housing 40, adapted to support the entire drawbar assembly, is securable to the center sill (not shown) of a railway car (not shown) by any technique such as welding. The support housing 40 is provided with elongated reinforcing ribs 42 behind a rectangular cavity 44 in the outer end thereof, which cavity 44 is adapted to receive and pivotally retain spool 30. The dimensions of cavity 44 must be sufficient to contain spool 30 and to permit some pivotal movement of spool 30 in a vertical plane. Cavity 44 is provided with a pair of axially aligned apertures 46 in the vertical side walls which apertures 46 are aligned with the first pair of axially aligned apertures 36 disposed in the first pair of vertically disposed, parallel side wall members 32 of spool 30. As was noted above, each aperture 36 is adapted to receive an interlocking disk member 22 for pivotally connecting spool 30 to the support housing 40. Hence each interlocking disk member 22 is disposed through an aperture 46 in support housing 40 and the adjacent, mating aperture 36 in spool 30, such that spool 30 is pivotal in a vertical plane on the interlocking disk members 22. Accordingly, the two interlocking disk members 22, although spaced apart, are axially aligned to function as would a single pin. As can be seen by contrasting FIGS. 3 and 4, the side wall of cavity 44 are closely spaced, but not so closely spaced as to prevent vertically disposed, wall members 34 on spool 30 from pivotal movement on disk members 22. The top and bottom side walls of cavity 44 are spaced significantly more to permit some pivotal movement of wall members 32 on spool 30, otherwise spool 30 would not be pivotal on disk members 22. Although not material for the purposes of this invention, support housing 40 is further provided with center plate 48 protruding downwardly from the underside to which a truck (not shown) can be rotatably attached, and a plurality of laterally extending vertical flanges 49, which are utilized to facilitate welding of the support housing 40 to the car structure.

The above described drawbar 10 is secured within spool 30 by inserting the butt end portion 14 through the rearward rectangular opening of spool 30 such that rectangular aperture 18 through drawbar 10 will be aligned with apertures 38 extending through the parallel, horizontally disposed top and bottom wall members 34 on spool 30. Accordingly, drawbar pivot pin 20, inserted within aligned apertures 38, will also extend through rectangular aperture 18 in drawbar 10.

A rear support block or follower 60, having a concave, hemispherical, buff load bearing surface 62 on one side, opposite a flat angled surface 64 on the other side, is vertically disposed within rectangular cavity 44 of support housing 40, such that concave, hemispherical buff load bearing surface 62 is engaged against convex, hemispherical buff load bearing surface 16 on drawbar 10. As in many comparable prior art drawbar assemblies, a gravity activated, slack adjusting wedge 66 is disposed between a rear end wall of rectangular cavity 44 and the adjacent angled surface 64 of rear support block 60. Accordingly, gravitational forces tending to pull gravity wedge 66 downwardly within cavity 44, will serve to bias gravity wedge 66 against rear support block 60, and accordingly bias concave, hemispherical buff load bearing surface 62 against its convex counter part on drawbar 10.

Preferably, gravity wedge 66 is provided with a biasing surface of an elastomeric material, which as shown, preferably comprises a pair of elongated elastomeric strips 68 vulcanized within a pair of vertical recesses on the rearward facing surface of gravity wedge 66, such that the elastomeric strips will be in contact with the flat end wall of rectangular cavity 44.

Figure 2:
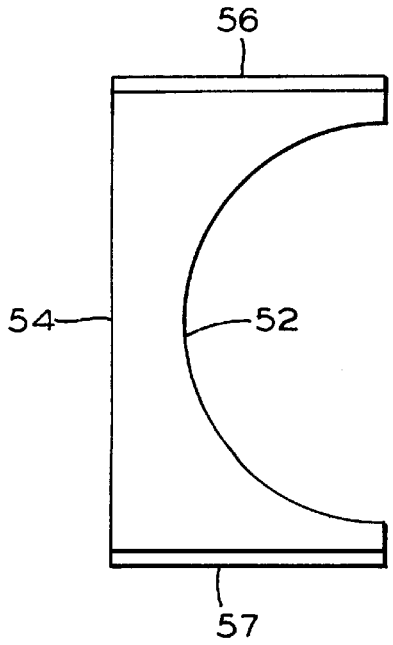
FIG. 2 is a top view of the bearing block shown in FIG. 1.

While the above discussion is addressed primarily to the entire drawbar coupler assembly, this invention is limited to the unique bearing block 50, as shown in FIGS. 1 and 2, and as may be utilized to pivotally attach drawbar 10 to pivot pin 20. Specifically, bearing block 50 is provided with a concave, half-cylindrical surface 52 on one side, which is adapted to engage against a cylindrical side surface of drawbar pivot pin 20, and on the opposite side is provided with a generally flat surface 54 which is disposed within generally rectangular aperture 18, such that generally flat surface 54 is disposed against a generally flat forward surface 19 of rectangular aperture 18, to thereby bias half cylindrical surface 52 of bearing block 50, against the side of drawbar pivot pin 20. As can be seen, the outward corners of aperture 16 in drawbar 10 are preferably rounded, not only to assure that a good flat surface 19 is achieved, but also to eliminate any possible stress risers at the intersection of the two side edges of the rectangular aperture 16.

In considering the above disclosed bearing block 50 in more detail as shown in FIGS. 1 and 2, it will be noted that the three generally flat surfaces 54, 55 and 56 are provided so that cylindrical surface 52 will be spaced from the opposed, generally flat surface 54. In addition, by properly spacing side surfaces 55 and 56, the parallel side surfaces of aperture 18 will serve to center bearing block 50, and accordingly center cylindrical surface 52 against drawbar pivot pin 20. It should also be apparent that the arcuate width of cylindrical surface 52 should preferably extend for somewhat less than 180° so that full contact of cylindrical surface 52 against drawbar pivot pin 20 can be maintained regardless of any wear of cylindrical surface 52. It will also be noted that in a preferred embodiment as shown, that flat surfaces 55 and 56 are flat only at the mid-sections thereof, having slightly tapered extremities. This is because the drawbar 10 can be expected to experience some degree of twisting in service. Therefore, the two surfaces 55 and 56 rather than being perfectly flat are provided with the slightly tapered top and bottom portions as shown, which will allow some twisting action of the drawbar 10 without causing any undue stresses on bearing block 50. Ideally, the tapered portions are tapered approximately 5° from the vertical surfaces at the mid-points of each surface 55 and 56. Accordingly, the drawbar 10 can experience a twisting action up to the same 5° in either direction, and still maintain a uniform biasing force against drawbar pivot pin 20.

While a presently preferred embodiment of the present invention has been described in detail above, it should be understood that persons skilled in the art may make various other modifications and adaptations of the invention without departing from the spirit or scope of the appended claims. For example, the two angled faces of faces 55 and 56 can be rounded-off to provide uniform curved faces if preferred. Accordingly, a number of other modifications and embodiments could be utilized without departing from the spirit of the invention.

We claim:

1. A bearing block for use in combination with a slackless drawbar coupler assembly for joining railway cars, said bearing block adapted for use in pivotally attaching a drawbar to a drawbar pivot pin wherein such drawbar is provided with an aperture through which such drawbar pivot pin is inserted, said bearing block comprising; a generally three-dimensional body having a concave, cylindrical surface on a first side adapted to engage against a convex cylindrical side surface of such drawbar pivot pin, and having an opposed, generally flat second side adapted to engage a peripheral side surface of such aperture in such drawbar, such that when properly inserted into such drawbar assembly, such drawbar will bias said concave, cylindrical surface on said bearing block against such drawbar pivot pin, said bearing block further includes a pair of generally flat side surfaces in a rectangular configuration adapted to mate with rectangularly arranged side wall surfaces of such aperture through such drawbar, said pair of generally flat side surfaces each have an upper and lower portion which is slightly sloped to permit some twisting movement of such drawbar against said bearing block.

2. A bearing block for use in combination with a slackless drawbar coupler assembly, according to claim 1, in which said sloped portions are sloped at a angle of 5°.

3. A bearing block for use in combination with a slackless drawbar coupler assembly, according to claim 1, in which said concave, cylindrical surface extends through an arc of less than 180°.

* * * * *